US005938411A

United States Patent [19]

Seo

[11] Patent Number: 5,938,411

[45] Date of Patent: Aug. 17, 1999

[54] COMPRESSOR NOISE REDUCING MUFFLER

[75] Inventor: Seung-Don Seo, Suwon, Rep. of Korea

[73] Assignee: Samsung Electronics Co., Ltd., Suwon, Rep. of Korea

[21] Appl. No.: 08/977,065

[22] Filed: Nov. 24, 1997

[30] Foreign Application Priority Data

Mar. 14, 1997 [KR] Rep. of Korea ..... P 97-8807

[51] Int. Cl.[6] ..... F04B 39/00

[52] U.S. Cl. ..... 417/312

[58] Field of Search ..... 417/312, 363; 181/403, 255, 269, 271, 275

[56] References Cited

U.S. PATENT DOCUMENTS 4,401,418 8/1983 Fritchman ..... 417/312
5,584,674 12/1996 Mo ..... 417/312
5,605,447 2/1997 Kim et al. ..... 417/312
5,703,336 12/1997 Tark et al. ..... 181/179
5,733,107 3/1998 Ikeda et al. ..... 417/312

*Primary Examiner*—Charles G. Freay
*Assistant Examiner*—Robert Z. Evora
*Attorney, Agent, or Firm*—Burns, Doane, Swecker & Mathis, L.L.P.

[57] ABSTRACT

A noise reducing muffler for a compressor includes a base muffler and a suction muffler connected to an upper end of the base muffler. Gaseous coolant flows through the suction muffler and the base muffler and into a cylinder head of a compressor. The suction muffler defines a path of travel wherein all of the gaseous coolant flows vertically downwardly, then horizontally, and then vertically downwardly to the base muffler.

2 Claims, 5 Drawing Sheets

COMPRESSOR NOISE REDUCING MUFFLER

BACKGROUND OF THE INVENTION

1. Field of the Invention

The present invention relates to a reciprocating compressor and more particularly to a compressor noise reducing apparatus which substantially reduces noise of a gas coolant, when the coolant is sucked during the operation of a compressor.

2. Description of the Prior Art

A conventional compressor as shown in FIGS. 1, 2 and 3 comprises a motor (20) having a rotor (21) and a stator (22), the rotor being rotated by magnetization formed therein. A crankshaft (30) is disposed at the center of the rotor to be rotated by the driving force of the rotor and a connecting rod (40) is installed at an eccentric area (30*a*) formed at the lower part of the crankshaft (30) to transform a rotating movement of the crankshaft (30) into a reciprocating movement of a piston (50) within a cylinder block (60).

Furthermore, bolted to an external side of the cylinder block (60) there is a cylinder head assembly (70) having openings for suction and discharging of a coolant. Resting on a portion (62) of the cylinder block (60) is a supporting bearing (61) arranged to support the rotor (21).

On the other hand, an oil pickup member (66) is installed at the eccentric portion (30*a*) of the crankshaft (30) to guide upwards the emulsion (67) stored in an oil chamber (65) by the rotation of the crankshaft (30).

The cylinder head part (70) is provided with a coolant inlet tube (71) to receive coolant supplied from an evaporator, a suction muffler (72) to reduce the noise generated from the coolant infused through the coolant inlet tube (71), and a base muffler (73) supporting the suction muffler (72) to guide the infused coolant and to prevent heat loss and heat transfer. A capillary tube (74) is inserted in a penetrating hole (73*a*) of the base muffler (73) to suck the lubricating and cooling emulsion (67) into the cylinder block (60), and a cylinder head (75) of the assembly (70) is coupled to the base muffler (73), the cylinder head (75) being divided into a suction room (75*a*) and a discharge room (75*b*). A valve plate (90) guides the coolant into the cylinder block (60) during the suction or discharging process, and a gasket (76) is disposed between the cylinder head (75) and the valve plate (90) to prevent leakage of the coolant gas. A suction valve (78) disposed between the cylinder block and the valve plate (90) includes a suction driving part (78*a*) arranged to cover a suction hole (91) of the valve plate (90) and is elastically opened or closed when the piston (50) carries out the suction stroke. A discharge valve body (100) positioned between the cylinder head (75) and the valve plate (90) enables coolant to be discharged through the valve plate (90) when the piston (50) carries out the compression stroke.

The discharge valve body (100) includes a discharge valve (101) having a discharge driving part (101*a*) to block the coolant from being discharged by closing the discharge hole (92) of the valve plate (90), a stopper (102) disposed beside the discharge valve (101) to prevent the discharge driving part (101*a*) from being excessively bent, and a keeper (103) installed beside the stopper (102) to keep the stopper (102) at a constant place.

The suction muffler (72), as shown in FIG. 4, comprises a muffler main body (721) connected to the base muffler (73), a muffler cover (723) assembled over the muffler main body (721) and having a suction hole (722) to receive coolant from the coolant inlet tube (71), and a baffle member (724) installed between the muffler main body (721) and the muffler cover (723) to reduce the noise generated when the coolant is sucked from the coolant inlet tube (71).

The baffle member (724), as illustrated in FIG. 5, includes an upper wall (724*b*) extending above a baffle plate (724*a*), and a lower wall (724*d*) forming a tapered-off shape to guide the coolant infused through a plurality of inlet holes (724*c*) formed in the baffle (724*a*).

Numeral (16) designates a discharge tube and a coolant discharge tube. As described above, in the conventional compressor noise reducing apparatus, the crankshaft (30) is rotated when the power is applied to the motor (20) and the connecting rod (40) undergoes reciprocating movement.

Accordingly, the piston (50) performs suction and compression strokes in the cylinder block (60).

When the piston (50) carries out the suction stroke, the coolant is infused into the muffler cover (723) through the suction inlet from the coolant inlet tube (71) and, then, passes through the inlet holes (724*c*) disposed inside the upper protruded wall (724*b*).

Furthermore. the coolant is guided into the suction room (75*a*) of the cylinder head (75) through the wall (724*d*) and, then, into the cylinder block (60) as the suction valve (78) is elastically opened.

When the piston (50) carries out the compression stroke, the coolant is passed through the discharge valve (101), collected into the discharge room (75*b*) of the cylinder head (75) and discharged out through the discharge tube (16). The noise generated when the coolant is sucked in the course of the procedures, as described above, is to be reduced while being passed through the baffle member (724).

However, there is a problem in the conventional compressor noise reducing apparatus in that, the coolant infused through the suction hole (722) of the suction muffler (72) is conducted continuously in a vertical direction through the inlet holes (724*c*) of the baffle member (724) and the base muffler (73), into the cylinder head (75). Thus, the coolant experiences low flowing resistance and improved cooling force, but conducts a reverse transmission of the noise occurring at the cylinder head.

SUMMARY OF THE INVENTION

The present invention is presented to solve the aforementioned problems and it is an object of the present invention to provide a compressor noise reducing apparatus to reduce the sound energy of the noise generated when the coolant is sucked, by preventing the noise from flowing in reverse.

In order to achieve the object of the present invention, there is provided a compressor noise reducing apparatus, the apparatus having a muffler main body connected to a base muffler, and a muffler cover assembled on a muffler main body with a suction inlet hole on a side thereof for sucking the coolant infused from a coolant suction tube. A baffle member is disposed between the muffler main body and the inner side of the muffler cover for reducing the noise generated when the coolant is sucked through the coolant suction tube. The baffle member includes a baffle plate formed with inlet holes and, a tube protruding downwardly through the baffle plate between the inlet holes. A plurality of horizontal holes is formed in the tube beneath the baffle plate for conducting gaseous coolant into the tube.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Figure 1:
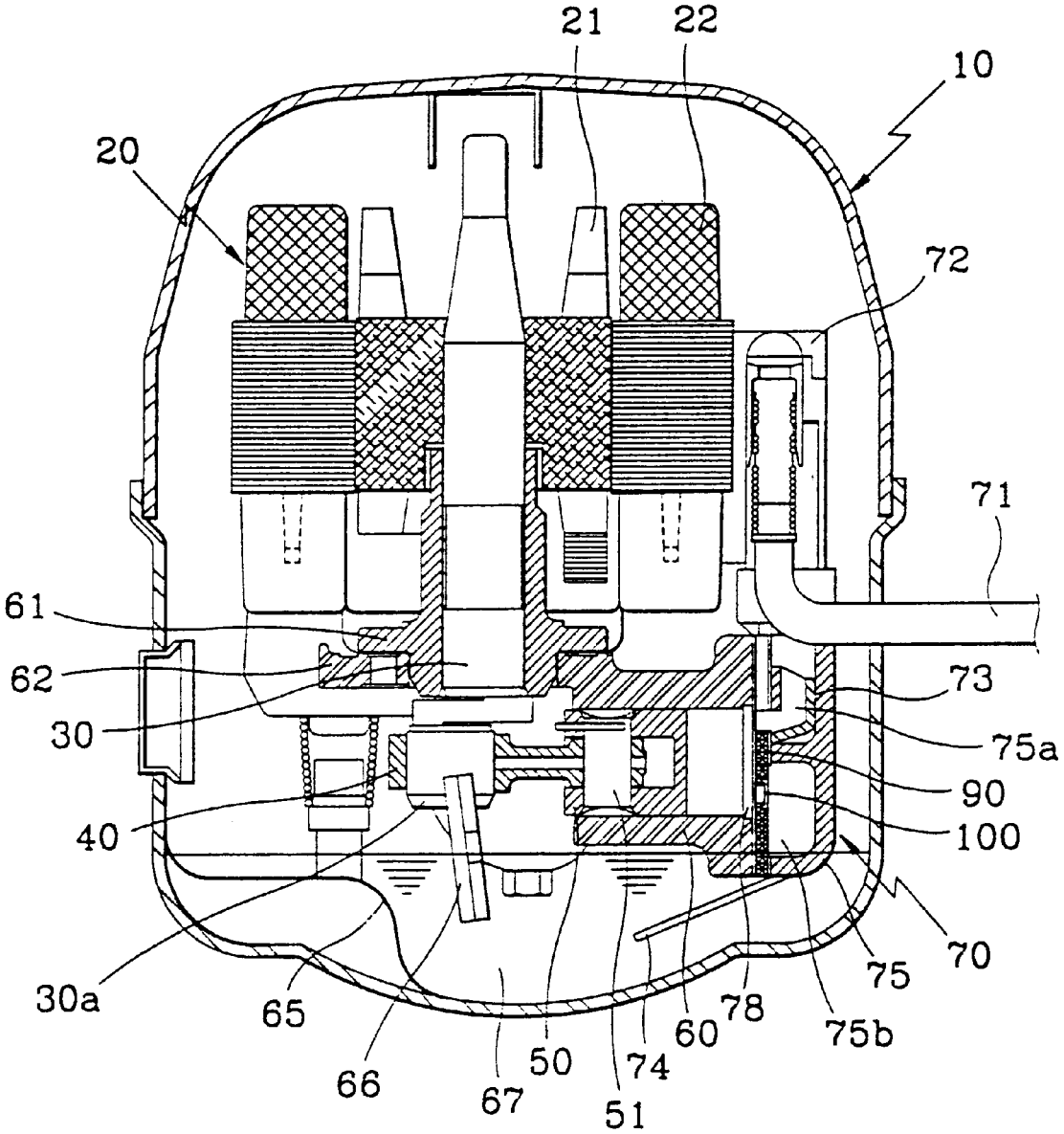
FIG. 1 (PRIOR ART)
FIG. 1 is a longitudinal sectional view of a conventional compressor.
Figure 2:
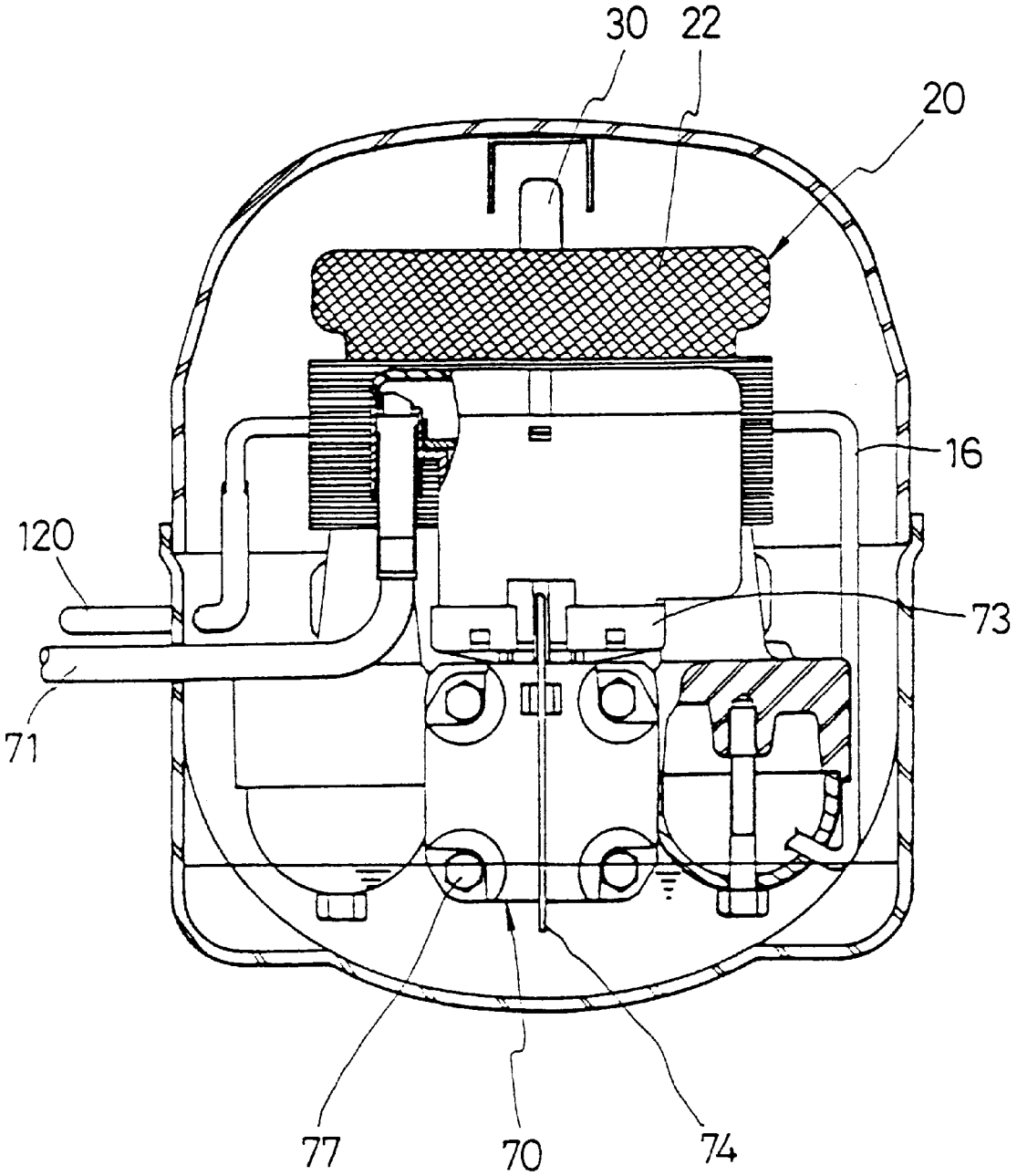
FIG. 2 (PRIOR ART)
FIG. 2 is another longitudinal sectional view of the conventional compressor.
Figure 3:
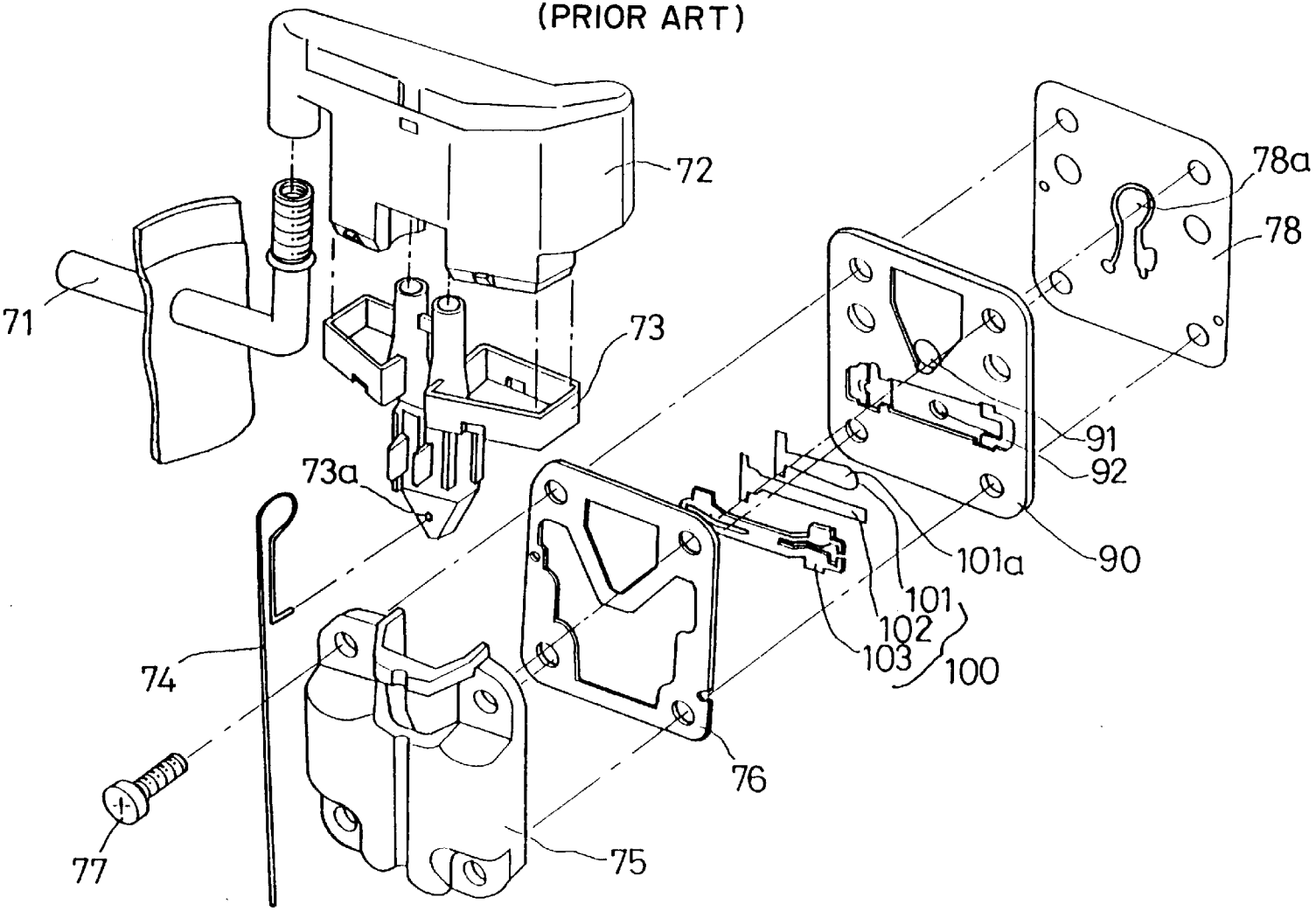
FIG. 3 (PRIOR ART)
FIG. 3 is an exploded perspective view for illustrating a conventional compressor valve.
Figure 4:
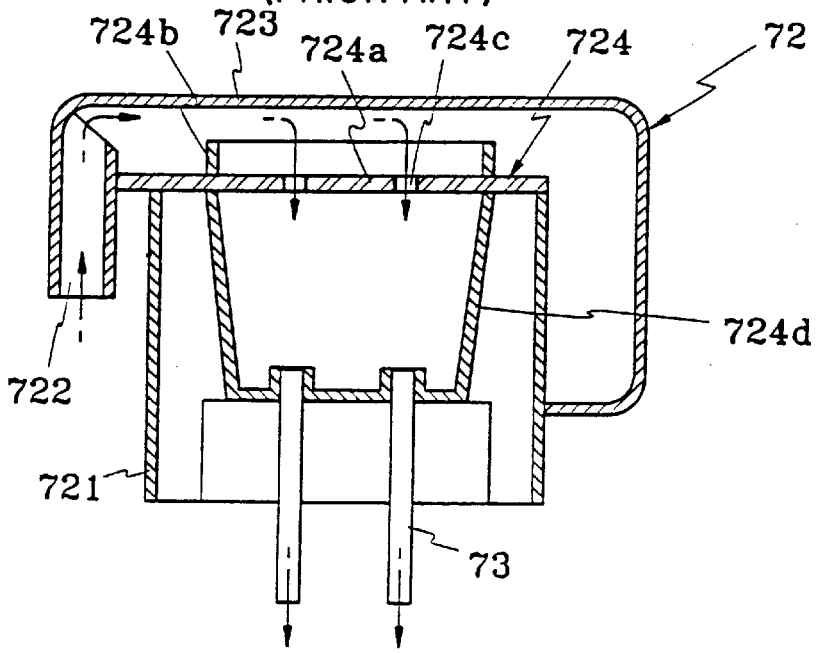
FIG.4 (PRIOR ART)
FIG. 4 is a longitudinal sectional view of a conventional compressor noise reducing apparatus.
Figure 5:
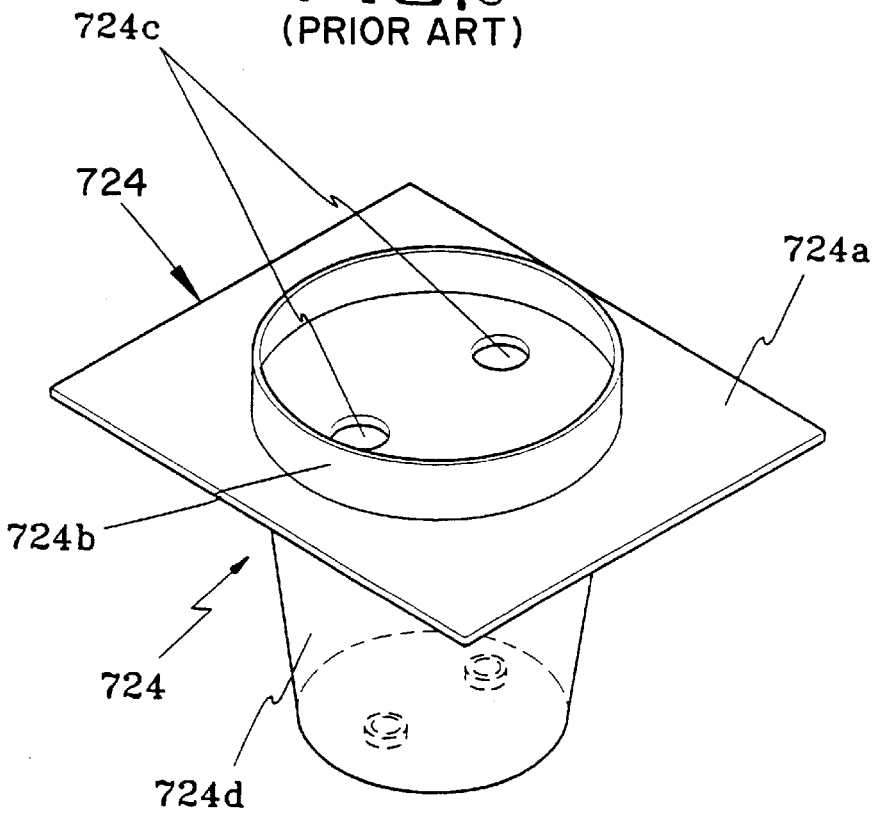
FIG.5 (PRIOR ART)
FIG. 5 is a perspective view for illustrating a baffle member of a conventional compressor noise reducing apparatus.
Figure 6:
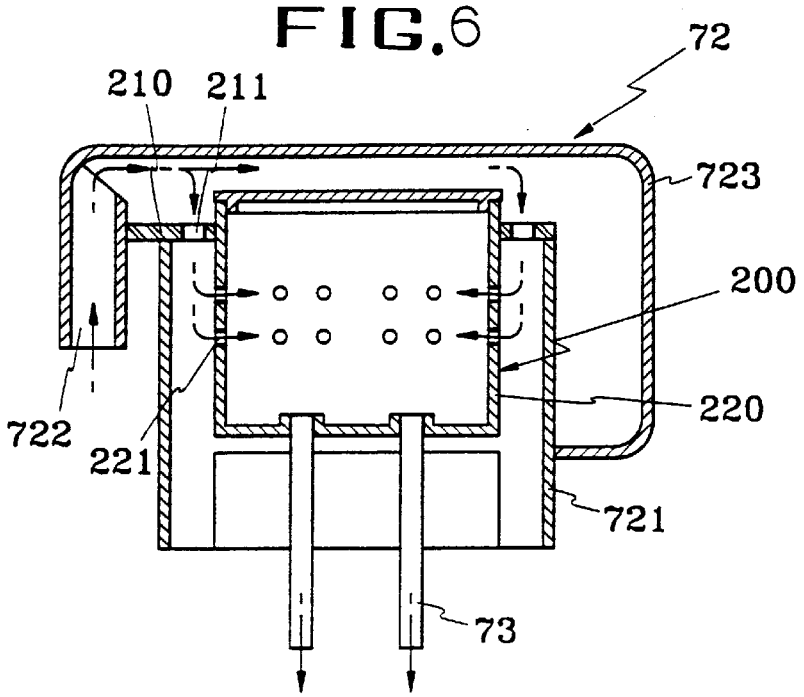
FIG. 6 is a longitudinal sectional view for illustrating a compressor noise reducing apparatus in accordance with the present invention.
Figure 7:
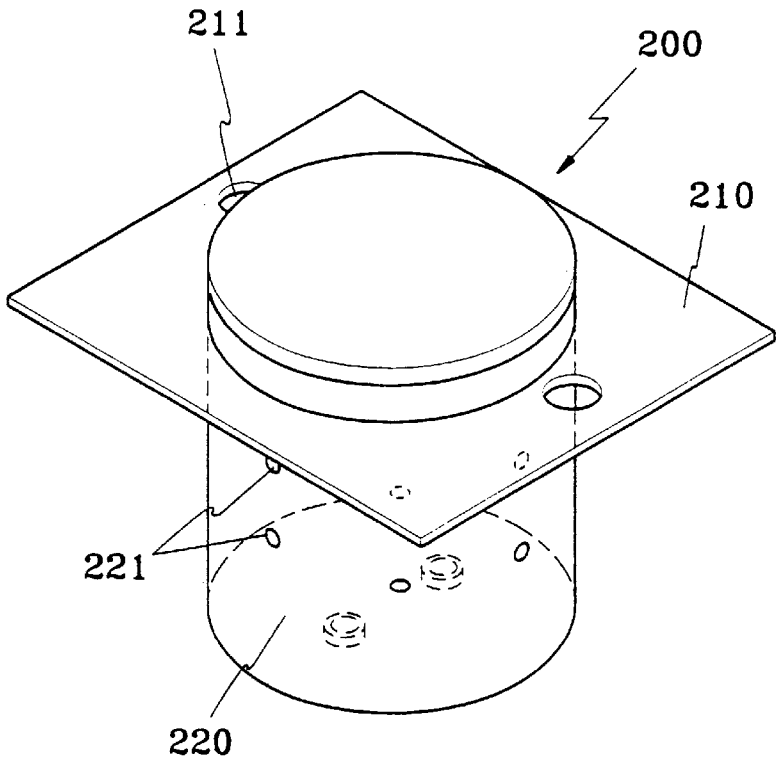
FIG. 7 is a perspective view for illustrating a baffle member of a compressor noise reducing apparatus in accordance with the present invention.

An embodiment of the present invention is described in detail with reference to the accompanying drawings, FIGS. 6 and 7. The compressor noise reducing apparatus of the present invention is provided with a suction muffler (72) mounted on a side of the cylinder head (75) by way of a base muffler (73) for reducing the noise generated when the coolant is infused through the coolant suction tube (71), in the manner described earlier herein.

The suction muffler (72) comprises a muffler main body (721) connected to the base muffler (73), a muffler cover (723) with a suction hole (722) to suck the coolant from a coolant inlet tube (71), and a baffle member (200) installed between the muffler main body (721) and the inner side of the muffler cover (723) for reducing the noise generated when the coolant is sucked through the coolant inlet tube (71).

Furthermore, the baffle member (200) includes a baffle plate (210) with inlet holes (211), a tubular wall (i.e., tube) (220) protruding downwards between the inlet holes (211), and a plurality of penetrating holes (221) formed horizontally through the protruded wall (220). The baffle plate separates the main body (721) from the cover (723) and forms a space therebetween into which gaseous coolant flows from the suction inlet (722).

Next, the operational effect of the present invention is described in detail below. When the piston (50) carries out the suction stroke, gas coolant of low temperature and low pressure from the evaporator is sucked through the suction muffler (72) and the base muffler (73), thereby generating noise. Then, the coolant enters the cylinder head (75). The coolant gas sucked through the suction hole (722) of the muffler cover (723) travels into the interior of the muffler main body (721) through the vertical inlet holes (221), thereby causing the noise of the coolant to be reduced for the first time.

The noise of the coolant is further reduced while being horizontally moved through the plurality of holes (221) and into the protruded wall (220). The upper end of the tubular wall (220) is covered, so that the coolant whose noise has been reduced in the aforementioned manner is conducted through the vertical tubes of the base muffler (73) downwards to the cylinder head (75) and, then, is discharged out as a coolant of high temperature and high pressure by way of the compression stroke of the piston installed at the cylinder.

Therefore, the coolant is, in sequence, vertically and then horizontally conducted en route to the cylinder head (75) by way of the baffle member (200) and the wall (220), thereby resulting in a substantial reduction of the coolant sound energy along with a higher flowing resistance and a slightly decreased cooling effect.

There is a substantially improved effect in the compressor noise reducing apparatus of the present invention in that, as the coolant is vertically and horizontally conducted by the baffle plate and the tubular wall before being supplied to the cylinder head, the apparatus not only prevents a reverse flow of the noise generated when the coolant is sucked but also produces a horizontal flow route of the coolant thereby reducing the sound energy of the noise.

What is claimed is:

1. A compressor noise reducing muffler comprising:

a base muffler for conducting gaseous coolant downwardly to a cylinder head, and a suction muffler connected to an upper end of the base muffler for conducting gaseous coolant thereto, the suction muffler including:

a main body, a cover mounted on the main body and including a suction inlet for receiving gaseous coolant, a generally horizontal baffle plate separating an interior of the main body from the cover to define a space therebetween into which gaseous coolant flows from the suction inlet, the baffle plate including a plurality of substantially vertical holes extending therethrough for conducting gaseous coolant from the space to the interior of the main body, and a tube extending downwardly through the baffle wall between the holes, a portion of the tube disposed in the interior of the main body and including a plurality of substantially horizontal holes extending therethrough for conducting all of the gaseous coolant from the interior of the main body into the tube, a lower end of the tube communicating with an upper end of the base muffler, and an upper end of the tube being covered so that the gaseous coolant flowing into the tube flows downwardly into the base muffler.

2. The compressor noise reducing muffler according to claim 1 wherein the base muffler includes a pair of vertical tubes.

* * * * *